US007381166B2

(12) United States Patent
Bazinet et al.

(10) Patent No.: US 7,381,166 B2
(45) Date of Patent: Jun. 3, 2008

(54) WEIGHTED SKIPPING EXERCISE DEVICE

(76) Inventors: Sandra J. Bazinet, 51 Highwood Cir., Colchester, CT (US) 06415; Kevin Terry, 36 Maple Ave., Extension, Uncasville, CT (US) 06382

( * ) Notice: Subject to any disclaimer, the term of this patent is extended or adjusted under 35 U.S.C. 154(b) by 0 days.

(21) Appl. No.: 11/497,001

(22) Filed: Aug. 2, 2006

(65) Prior Publication Data

US 2007/0032354 A1 Feb. 8, 2007

Related U.S. Application Data

(60) Provisional application No. 60/706,187, filed on Aug. 8, 2005.

(51) Int. Cl.
*A63B 5/22* (2006.01)
*A63B 21/00* (2006.01)

(52) U.S. Cl. ..... 482/81; 482/82; 482/79

(58) Field of Classification Search ..... D21/465–467, D21/672; 446/26, 247, 236, 248; 482/79–82, 482/132, 148; 40/633; 273/453, 440, 449
See application file for complete search history.

(56) References Cited

U.S. PATENT DOCUMENTS

| | | | | |
|---|---|---|---|---|
| 2,071,041 | A * | 2/1937 | Maggio | 446/247 |
| 3,140,871 | A | 7/1964 | Liquori | |
| 3,162,979 | A * | 12/1964 | Garoogian | 446/242 |
| 3,410,554 | A * | 11/1968 | Harrison | 273/453 |
| 3,528,654 | A | 9/1970 | Larson et al. | |
| 4,639,979 | A | 2/1987 | Polson | |
| 4,875,675 | A | 10/1989 | Arad et al. | |
| 5,283,969 | A * | 2/1994 | Weiss | 40/633 |
| 5,603,651 | A | 2/1997 | Shure et al. | |
| 5,647,828 | A * | 7/1997 | Chen | 482/132 |
| 6,113,452 | A | 9/2000 | McGowan et al. | |
| 6,186,858 | B1 * | 2/2001 | Cotoia | 446/250 |
| 6,579,142 | B1 * | 6/2003 | Rehkemper et al. | 446/247 |
| 6,695,671 | B2 | 2/2004 | Kessler | |
| 6,776,679 | B1 | 8/2004 | Menow | |
| 6,977,330 | B2 * | 12/2005 | Santa Cruz et al. | 84/322 |
| 7,101,321 | B2 * | 9/2006 | Kessler | 482/81 |
| 7,192,330 | B2 * | 3/2007 | Van Dan Elzen | 446/250 |
| 2004/0097344 | A1 | 5/2004 | Kessler | |
| 2004/0192156 | A1 * | 9/2004 | Abel | 446/26 |

* cited by examiner

*Primary Examiner*—Glenn Richman
(74) *Attorney, Agent, or Firm*—Mark E. Pochal

(57) ABSTRACT

A weighted skipping exercise device for cardio-aerobic exercise. A leg ring is attached to a cone element containing adjustable weights by an elongated cord. The elongated cord having a first loop end positioned within a channel around a the outer circumference of the leg ring. A second cord end connected to the cone element by an attaching means permitting free rotation of the cone element. The cone element comprising a top cone attached to the second cord end and a bottom cup having a circular slot for containment of the adjustable weights. The top cone and bottom cup threaded together by a friction ring comprise the cone element. The cone element and adjustable weights attached by the elongated cord revolve in a circular path around the user by movement of the leg ring positioned around a user's first leg and continuous revolutions maintained byjumping or skipping over the circular path of the device with a second leg of the user.

19 Claims, 6 Drawing Sheets

WEIGHTED SKIPPING EXERCISE DEVICE

RELATED APPLICATIONS

This application claims priority from U.S. Provisional Patent Application Ser. No. 60/706,187 which was filed on Aug. 8, 2005.

TECHNICAL FIELD

The present invention relates to a weighted skipping exercise device, more specifically in combination a leg ring attached by a elongated cord to a cone shaped element containing adjustable weights.

BACKGROUND OF THE INVENTION

Skipping toys using a leg ring and object attached by an elongated cord have been known for many years for use primarily as amusement toys. In operation, the leg ring is placed around a user's leg and by continuous movement of said leg the attached object and elongated cord revolve in a circular path requiring the user to skip or jump over the elongated cord with the opposite leg to maintain continuous revolutions.

The prior art discloses variations of the revolving object to increase the amusement of these toys. One example is disclosed in U.S. Pat. No. 5,603,651 (Shure et al.) in which a bubble producing mechanism is enclosed in the revolving object. Another example is disclosed in U.S. Pat. No. 6,113,452 (McGowan et al.) in which the revolving object contains a marker for marking the surface as the object travels.

Another example is disclosed in U.S. Pat. No. 6,695,671 B2 (Kessler) which the revolving object is a wheel containing small lamps and a generator which light upon rotation.

The present invention has for its primary objective to provide a cardiovascular aerobic device utilizing an improved leg ring, an elongated cord and a cone element adapted for quick and easy adjustment of weights contained therein. Additional uses include leg shaping and conditioning, sports training and stress reduction.

SUMMARY OF THE INVENTION

An object of the present invention is to provide a novel, interesting cardiovascular aerobic device that utilizes a leg ring, elongated cord and cone element that is safe to the user and provides different levels of cardiovascular conditioning and leg strengthening by adjusting the weight of the cone element.

A further object of the invention is to provide utility in sports training, aerobic exercise, stress reduction and amusement to the operator.

A further object of the invention is to utilize different weights inserted in the cone element for increased or decreased force on the leg attached to the leg ring.

A further object of the invention is the method for quick and easy adjustment of the weight contained within the cone element.

A further object of the invention is to utilize a friction device flange bushing in attaching the elongated cord to the cone element to prevent wearing of the cone and cord with rotation of the cone element.

A further object of the invention is to attach the elongated cord around the leg ring within a channel in the outer circumference of the leg ring providing increased strength of the elongated cord preventing breakage of the elongated cord with the use of the weighted cone element.

In accord with the invention, the weighted skipping exercise device is comprised of a leg ring, in the preferred embodiment constructed of plastic extrusion or other suitable materials, with a channel around the outer circumference to accommodate an elongated cord made of vinyl or rubber coated steel cable in the preferred embodiment, or other suitable materials. The leg ring opens to allow room for fitting over a user's shoe. The leg ring has a snap clip permanently attached to one end which connects to the second end when positioned around the user's shoe forming a continuous leg ring.

The elongated cord situated within the outer leg ring channel contains a oval stop sleeve, which completes the cord loop around the leg ring.

The oval stop sleeve is positioned on the elongated cord to provide a cord loop sufficient in circumference to allow the leg ring to be opened for placement over the user's shoe or for removal.

The elongated cord, at the end opposite the cord loop, is attached to a cone element by a cylindrical stop sleeve and flange bushing that allows the cone element to spin unrestricted without wear to the cone element or elongated cord.

The cone element, preferably made of ABS plastic or other suitable materials, consists of a top cone attached to the elongated cord, and a base cup threaded together by a friction ring.

The base cup consists of an interior cavity for retaining adjustable weights.

In operation, the elongated cord and cone element horizontally rotate from a circular motion of the user's leg with the leg ring attached, and the user's non-ringed leg is raised over the cone element to allow for unfettered rotation.

The friction ring causes the cone element to spin on rotation or roll on contact with the surface.

The foregoing and other objects, features and advantages of the present invention will become more apparent from the following description of preferred embodiments and accompanying drawings.

DETAILED DESCRIPTION OF THE DRAWINGS

Figure 1:
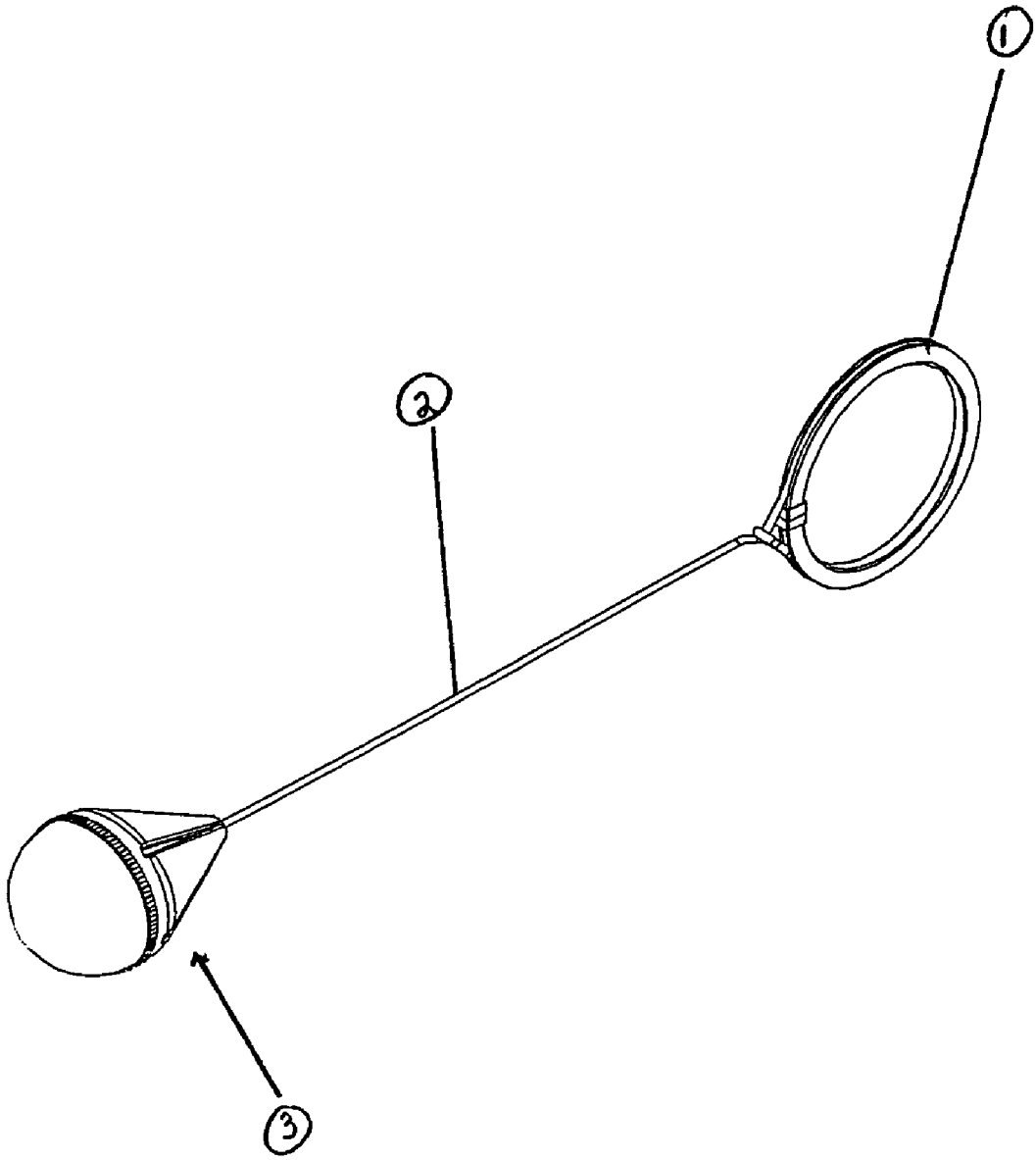
FIG. 1 is a front elevational view of the weighted skipping exercise device comprising the leg ring, elongated cord and cone element.

The invention is principally described in FIG. 1 in terms of a generally circular leg ring (1) attached by elongated cord (2) at one end and a cone element (3) attached at the opposite end of elongated cord (2).

Figure 2:
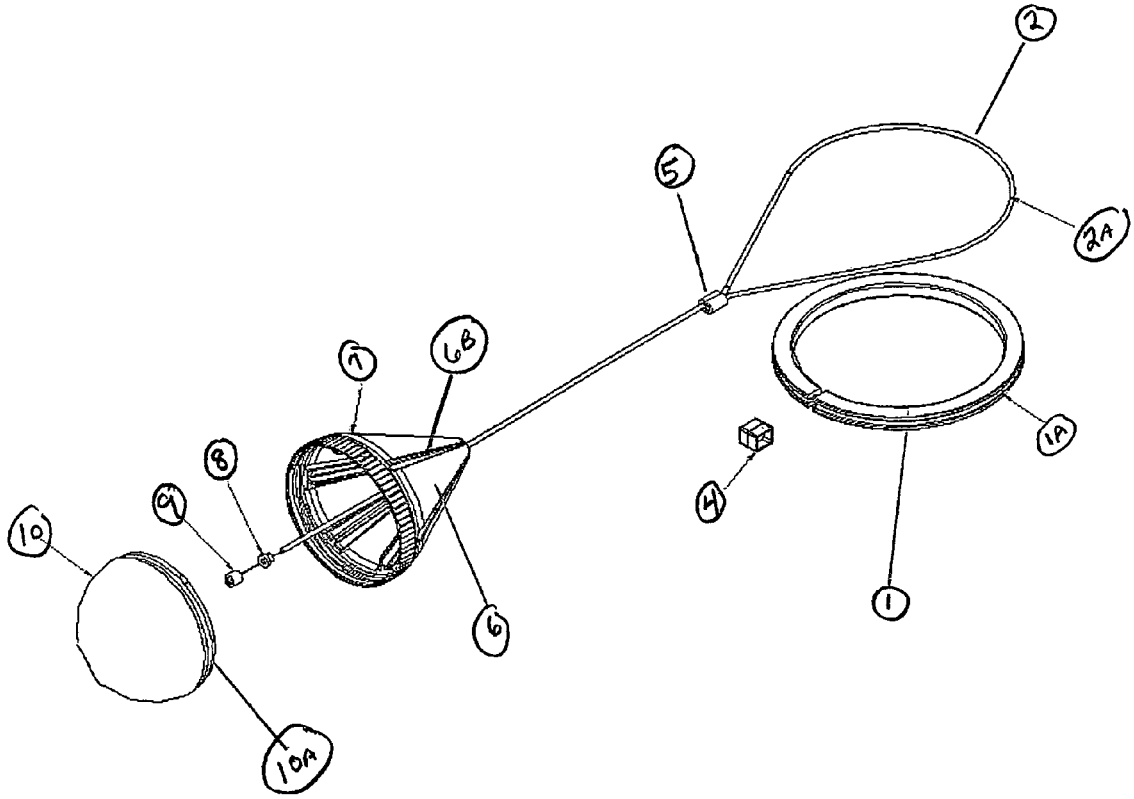
FIG. 2 is an isolated view of the weighted skipping exercise device components.
Figure 3:
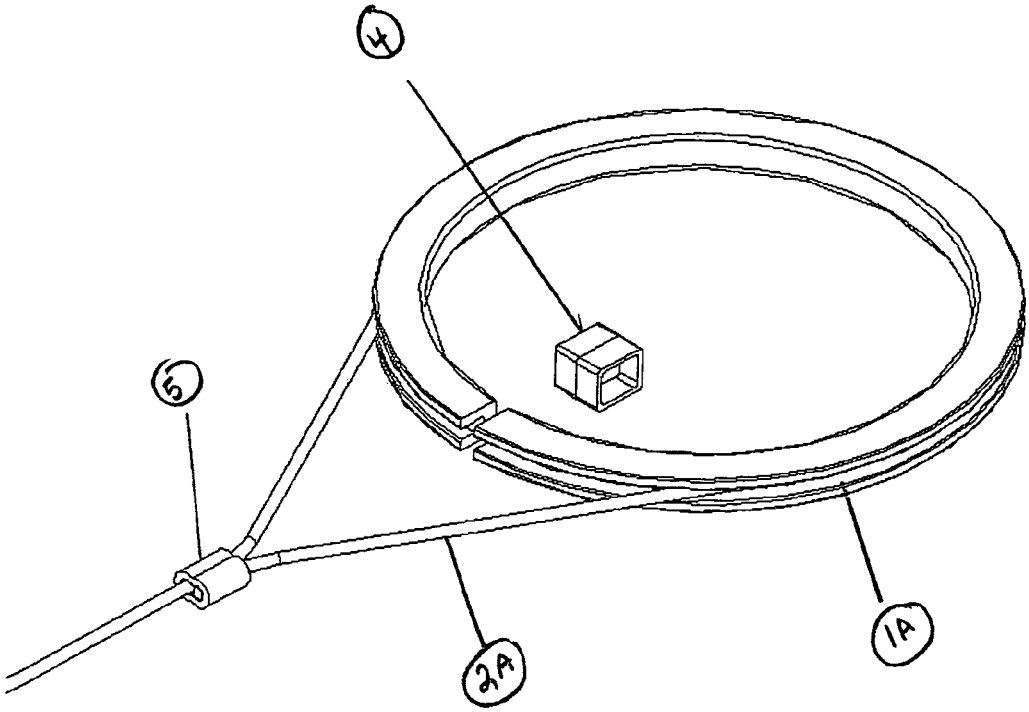
FIG. 3 is an isolated view of the expandable leg ring and snap clip, the elongated cord loop contained around the outer circumference of the leg ring and the oval stop sleeve.
Figure 4:
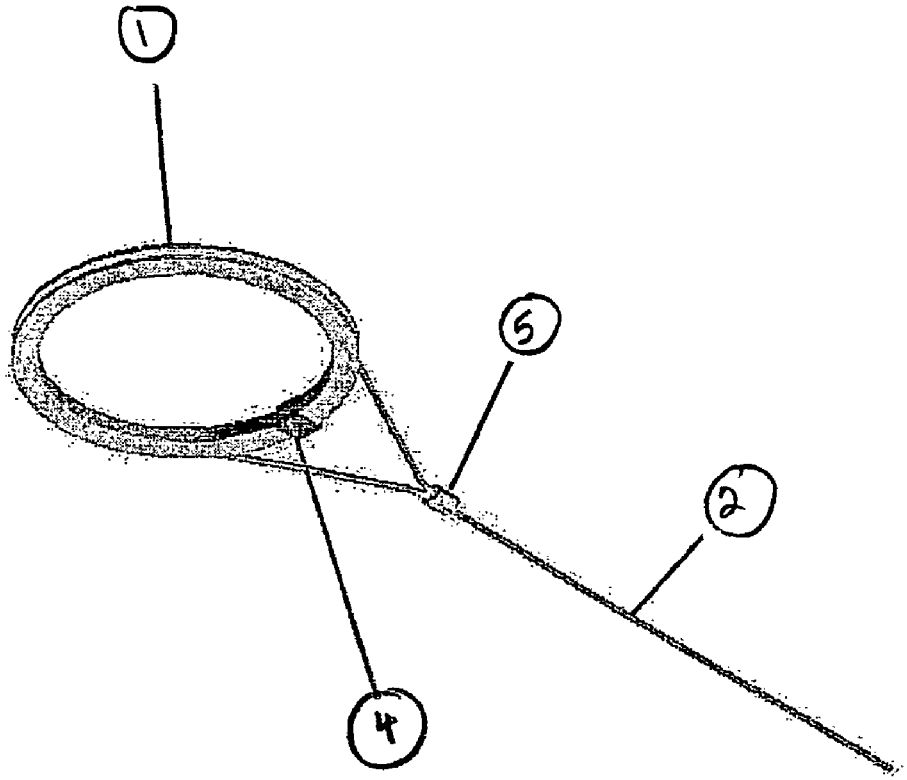
FIG. 4 is an isolated view of the leg ring and snap clip forming a continuous ring for operation.

As illustrated in FIGS. 2 and 3, leg ring (1) is opened at one end for expanding to fit over a user's foot for operation. Leg ring (1) contains a snap clip (4) permanently attached to one end of leg ring (1) for communication with the second end of leg ring (1) to form a continuous ring, as illustrated in FIG. 4.

Leg ring (1), as illustrated in FIG. 3 consists of a cable retention channel (1*a*) around the outer circumference for retention of elongated cord (2). Elongated cord (2) at one end having a oval stop sleeve (5) to form a loop (2*a*) to close elongated cord (2) around leg ring (1). Oval stop sleeve (5) is positioned on elongated cord (2) at a length sufficient enough to permit opening of leg ring (1) when loop (2*a*) is around leg ring (1).

Leg ring (1) in the preferred embodiment, is constructed of extruded polypropylene or polyethylene plastic, but may be made of other suitable materials. Elongated cord (2) is constructed of vinyl or rubber coated steel in the preferred embodiment, but may be made of other suitable materials. Elongated cord (2) at the loop end (2) positioned within cable retention channel (1*a*) of leg ring (1) is capable of withstanding at least 50 pounds of force when in use.

Figure 5:
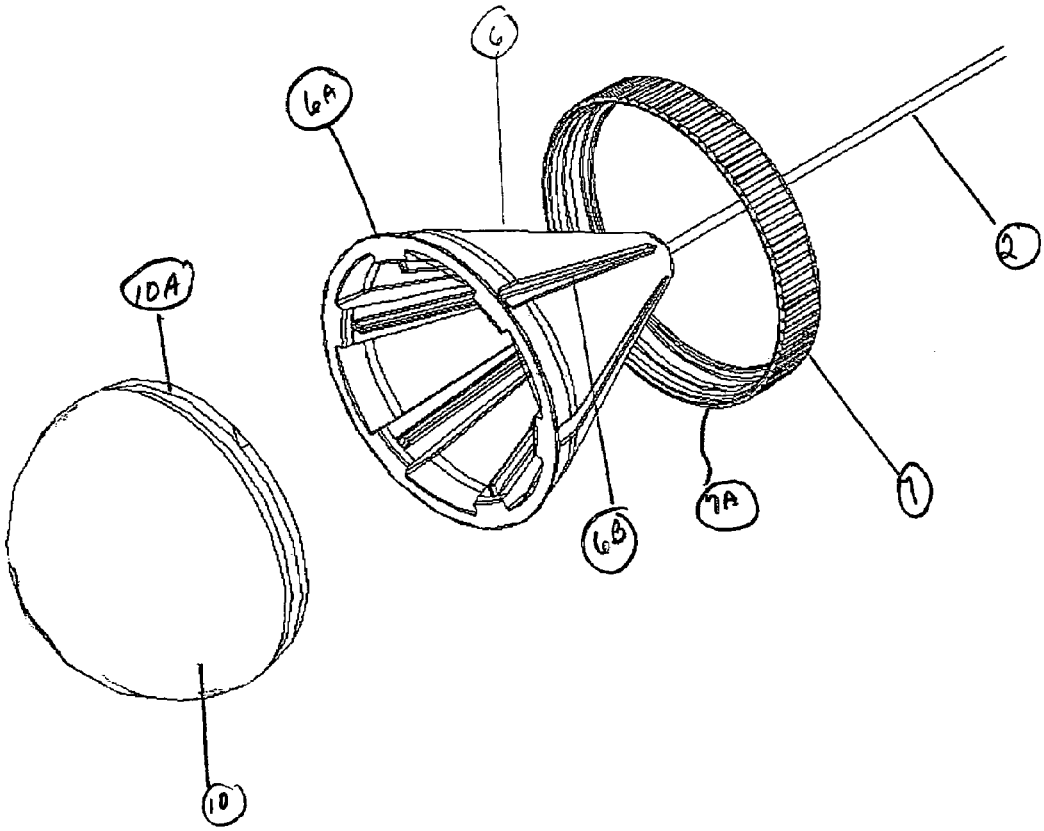
FIG. 5 is an isolated view of the cone element attached to the elongated cord.

Elongated cord (2) at the second end is connected to cone element (3). As illustrated in FIG. 5, cone element (3) comprises a top cone (6), a friction ring (7) and a base cup (10). Elongated cord (2) at the second end passes through an opening in the top of top cone (6) and is secured to top cone (6) by a cylindrical stop sleeve (9) and flange bushing (8) attached to the second end of elongated cord (2).

Flange bushing (8) minimizes friction between top cone (6) and allows free rotation of cone element (3).

Top cone (6) consists of a plurality of symmetrically positioned grooves (6*b*) to form a ribbed exterior for protection of top cone (6) when cone element (3) comes in contact with the surface. Top cone (6) has a base end consisting of a flange (6*a*), illustrated in FIG. 5, for retention of friction ring (7).

Friction ring (7), containing internal threads (7*a*), slides over top cone (6) and rests on flange (6*a*) at the base. Friction ring (7) is constructed of ABS plastic, in the preferred embodiment, but other suitable materials may be used.

Figure 6:
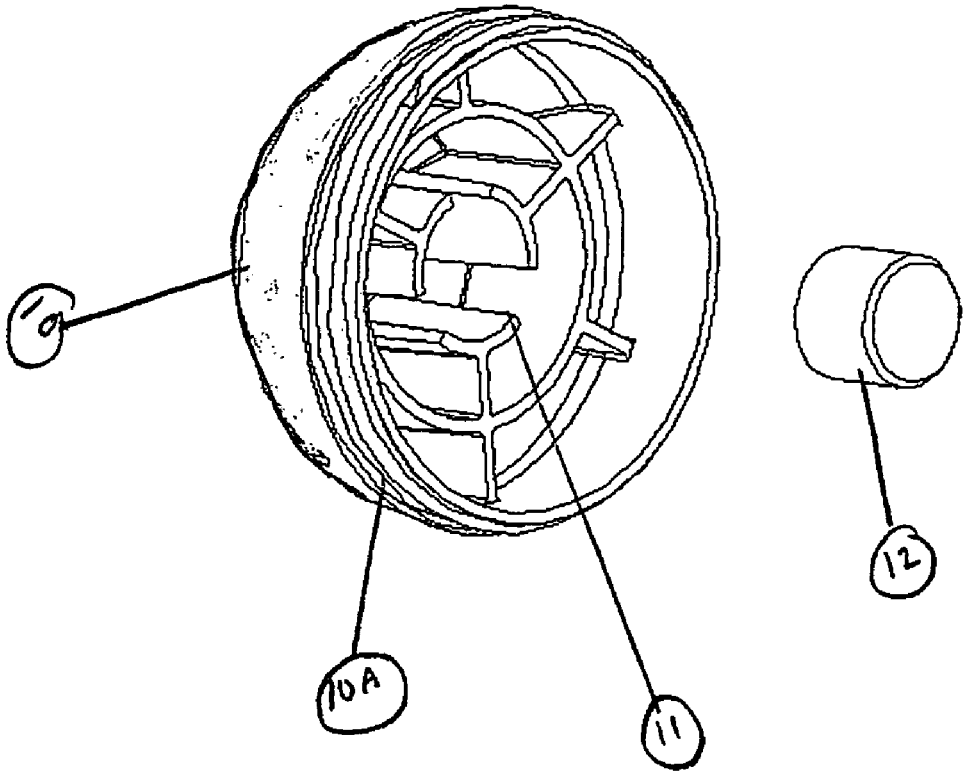
FIG. 6 is an isolated view of the base cup of the cone element and weight.

Base cup (10) contains external threads (10*a*) at the opening. As illustrated in FIG. 6, internal to base cup (10) is a circular slot (11) for receiving and retaining weight (12) during use.

Base cup (10) and top cone (6) are joined together to comprise cone element (3) by screw twisting friction ring (7) mating external threads (10*a*) of base cup (10) to internal threads (7*a*) of friction ring (7).

The snap clip (4) is constructed of polyethylene or UHMW polypropylene, in the preferred embodiment, but may be made of other suitable materials.

Weight (12) is constructed of aluminum or steel in the preferred embodiment and consist of various sizes which may be used individually or stacked in circular slot (11).

Although this invention has been shown and described with respect to some embodiments, it will be understood by those skilled in this art that various changes in form and detail thereof may be made without departing from the spirit and scope of the claimed invention.

We claim:

1. A weighted exercise skipping device comprising:

a). a circular leg ring having an outer cable retention channel around the circumference;

b). a cone element having a top cone and a base cup connected by a fastening means;

c). a plurality of weights positioned within the cone element; said weights being various sizes and stacked in plurality within a internal circular slot within the cone element; and d). an elongated cable having a first loop end positioned securely within the cable retention channel of the leg ring and a second end connected to the cone element permitting rotation in unison of said leg ring and cone element about a user's leg.

2. The weighted exercise skipping device of claim 1, wherein the circular leg ring is open at one end for expanding the circular leg ring.

3. The circular leg ring of claim 2, further comprising:

a snap clip permanently attached to one a first end at the opening of the leg ring for retaining a second end of the leg ring securing the circular leg ring during use.

4. The weighted exercise skipping device circular leg ring of claim 2, wherein the circular leg ring is composed of extruded plastic for flexibility in opening and closing the circular leg ring.

5. The weighted exercise skipping device of claim 1, wherein the top cone comprises a top end and a base, the top end having a opening for attachment to the elongated cable by a connecting means.

6. The top cone of claim 5, further comprising a flange around the base.

7. The top cone of claim 5, wherein the connecting means consists of a cylindrical stop sleeve crimped to the second end of the elongated cable which passes through the top cone and is retained within the top cone.

8. The connecting means of claim 7, further comprising a flange bushing positioned between the cylindrical stop sleeve and top cone.

9. The weighted skipping exercise device of claim 1, wherein the top cone consists of a plurality of symmetrically positioned grooves.

10. The weighted skipping exercise device of claim 1, wherein the base cup contains a plurality of external threads.

11. The weighted skipping exercise device of claim 1, wherein the base cup contains said internal circular slot for receiving and containing the plurality of weights.

12. The weighted skipping exercise device of claim 1, wherein the fastening means consists of a friction ring.

13. The friction ring of claim 12, further consisting of a plurality of internal threads.

14. The friction ring of claim 12, is positioned over the top cone and retained thereon by the flange at the base of the top cone, the friction ring connects the top cone and the base cup by mating of the external threads of the base cup to the internal threads of the friction ring supported against the top cone.

15. The weighted skipping exercise device of claim 1, wherein the elongated cable contains a oval stop sleeve at the first loop end.

16. The weighted skipping exercise device of claim 1, wherein the elongated cable is composed of vinyl.

17. The weighted skipping exercise device of claim 1, wherein the elongated cable is composed of rubber coated steel.

18. The weighted skipping exercise device of claim 1, wherein the plurality of weights are composed of aluminum.

19. The weighted skipping exercise device of claim 1, wherein the plurality of weights are composed of steel.

* * * * *